US009175857B2

(12) United States Patent
Melton et al.

(10) Patent No.: US 9,175,857 B2
(45) Date of Patent: Nov. 3, 2015

(54) COMBUSTOR CAP ASSEMBLY

(75) Inventors: Patrick Benedict Melton, Horse Shoe, NC (US); Robert Joseph Rohrssen, Greenville, SC (US); Thomas Edward Johnson, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 721 days.

(21) Appl. No.: 13/555,481

(22) Filed: Jul. 23, 2012

(65) Prior Publication Data

US 2014/0020389 A1 Jan. 23, 2014

(51) Int. Cl.

| | |
|---|---|
| ***F23R 3/10*** | (2006.01) |
| ***F23R 3/46*** | (2006.01) |
| ***F23R 3/28*** | (2006.01) |

(52) U.S. Cl.

CPC . *F23R 3/10* (2013.01); *F23R 3/283* (2013.01); *F23R 3/46* (2013.01); *F23R 2900/03042* (2013.01); *F23R 2900/03044* (2013.01)

(58) Field of Classification Search

CPC ..... F23R 3/10; F23R 3/283; F23R 3/46; F23R 2900/03044; F23R 2900/03042; F23R 3/002; F05D 2260/201

See application file for complete search history.

(56) References Cited

U.S. PATENT DOCUMENTS

| | | | | |
|---|---|---|---|---|
| 4,365,470 | A * | 12/1982 | Matthews et al. | 60/800 |
| 4,914,918 | A * | 4/1990 | Sullivan | 60/756 |
| 6,438,959 | B1 | 8/2002 | Dean et al. | |
| 6,546,733 | B2 * | 4/2003 | North et al. | 60/772 |
| 6,923,002 | B2 | 8/2005 | Crawley et al. | |
| 1,880,255 | A1 | 7/2009 | Green et al. | |
| 2010/0058766 | A1 * | 3/2010 | McMahan et al. | 60/747 |
| 2010/0263384 | A1 * | 10/2010 | Chila | 60/755 |
| 2012/0111012 | A1 * | 5/2012 | Axelsson et al. | 60/737 |

* cited by examiner

*Primary Examiner* — Phutthiwat Wongwian
*Assistant Examiner* — Carlos A Rivera
(74) *Attorney, Agent, or Firm* — Dority-Manning, PA

(57) ABSTRACT

One embodiment of the present invention is a cap insert for a combustor fuel nozzle cap assembly. The cap insert generally includes a cap plate that defines a fuel nozzle passage and may have an upstream peripheral edge. An impingement plate having a body may generally define an axially extending annular sleeve and a radially outer portion that circumferentially surrounds the body. The radially outer portion may include an upstream end axially separated from a downstream end. The axially extending annular sleeve may define an annular passage through the body. The cap plate upstream peripheral edge may be contiguous with the downstream end of the impingement plate body radially outer portion.

17 Claims, 4 Drawing Sheets

COMBUSTOR CAP ASSEMBLY

FIELD OF THE INVENTION

The present invention generally involves a combustor cap assembly having a cap insert.

BACKGROUND OF THE INVENTION

Gas turbines often include a compressor, a number of combustors, and a turbine. Typically, the compressor and the turbine are aligned along a common axis, and the combustors are positioned between the compressor and the turbine in a circular array about the common axis. In operation, the compressor creates a compressed working fluid, such as compressed air, which is supplied to the combustors. A fuel is supplied to the combustor through one or more fuel nozzles and at least a portion of the compressed working fluid and the fuel are mixed to form a combustible fuel-air mixture. The fuel-air mixture is ignited in a combustion zone that is generally downstream from the fuel nozzles, thus creating a rapidly expanding hot gas. The hot gas flows from the combustor into the turbine. The hot gas imparts kinetic energy to multiple stages of rotatable blades that are coupled to a turbine shaft within the turbine, thus rotating the turbine shaft and producing work.

To increase turbine efficiency, modern combustors may be operated at high temperatures which generate high thermal stresses on various components disposed within the combustor. As a result, at least a portion of the compressed working supplied to the combustor may be used to cool the components before being mixed with the fuel for combustion. For example, many modern combustors may include a generally annular cap assembly that at least partially surrounds the fuel nozzles. The cap assembly generally provides structural support for the fuel nozzles and may at least partially define a flow path for the fuel-air mixture to follow just prior to entering the combustion zone. Certain cap assemblies include a generally annular cap plate that is disposed at a downstream end of the cap assembly and that is adjacent to the combustion zone.

Current cap assembly designs generally comprise of multiple complex components, thereby requiring complex manufacturing and assembly techniques. The complexity of the current cap assembly designs generally require multiple connection points such as welds joints or brazed joints, thereby increasing the probability of cycle fatigue and potentially limiting the life of the cap assembly. In addition, the complexity of the designs may significantly increase the time required to assemble and/or disassemble and/or repair the cap assembly, thereby resulting in additional labor costs and outage costs. Therefore, a cap assembly that requires fewer components and that may be less costly to assemble and/or repair would be useful.

BRIEF DESCRIPTION OF THE INVENTION

Aspects and advantages of the invention are set forth below in the following description, or may be obvious from the description, or may be learned through practice of the invention.

One embodiment of the present invention is a cap insert for a combustor fuel nozzle cap assembly. The cap insert generally includes a cap plate that defines a fuel nozzle passage and may have an upstream peripheral edge. An impingement plate having a body that generally defines an axially extending annular sleeve and a radially outer portion that circumferentially surrounds the body. The radially outer portion may include an upstream end axially separated from a downstream end. The axially extending annular sleeve may define an annular passage through the body. The cap plate upstream peripheral edge may be contiguous with the downstream end of the impingement plate body radially outer portion.

Another embodiment of the present invention is a cap insert for a combustor. The cap insert may generally include an impingement plate having a body that defines an axially extending annular sleeve. The annular sleeve may define a passage through the body. A cap plate may define a fuel nozzle passage generally coaxial with the annular sleeve. The cap plate may include an upstream peripheral edge. The upstream peripheral edge may be generally contiguous with a downstream end of the impingement plate. A connecting sleeve may be generally contiguous with an upstream end of the impingement plate such that the cap plate and the connecting plate are generally axially separated by the impingement plate.

In yet another embodiment, a combustor may comprise an end cover disposed at one end of the combustor, and a fuel nozzle that extends axially downstream from the end cover. A cap assembly at least partially surrounds the fuel nozzle and extends generally axially downstream from the end cover. The cap assembly may include an opening at a downstream end of the cap assembly. The combustor may further include a cap insert disposed within the cap assembly opening. The cap insert may generally include an impingement plate having a body. The body may define an axially extending annular sleeve. The annular sleeve may define a passage through the body. A plurality of axially extending cooling passages may extend through the body. A cap plate may generally define a fuel nozzle passage generally coaxial with the impingement plate body axially extending annular sleeve. The cap plate may generally include an upstream peripheral edge that may be generally contiguous with a downstream end of the impingement plate. The cap insert may further include a connecting sleeve contiguous with an upstream end of the impingement plate such that the cap plate and the connecting sleeve are axially separated by the impingement plate.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
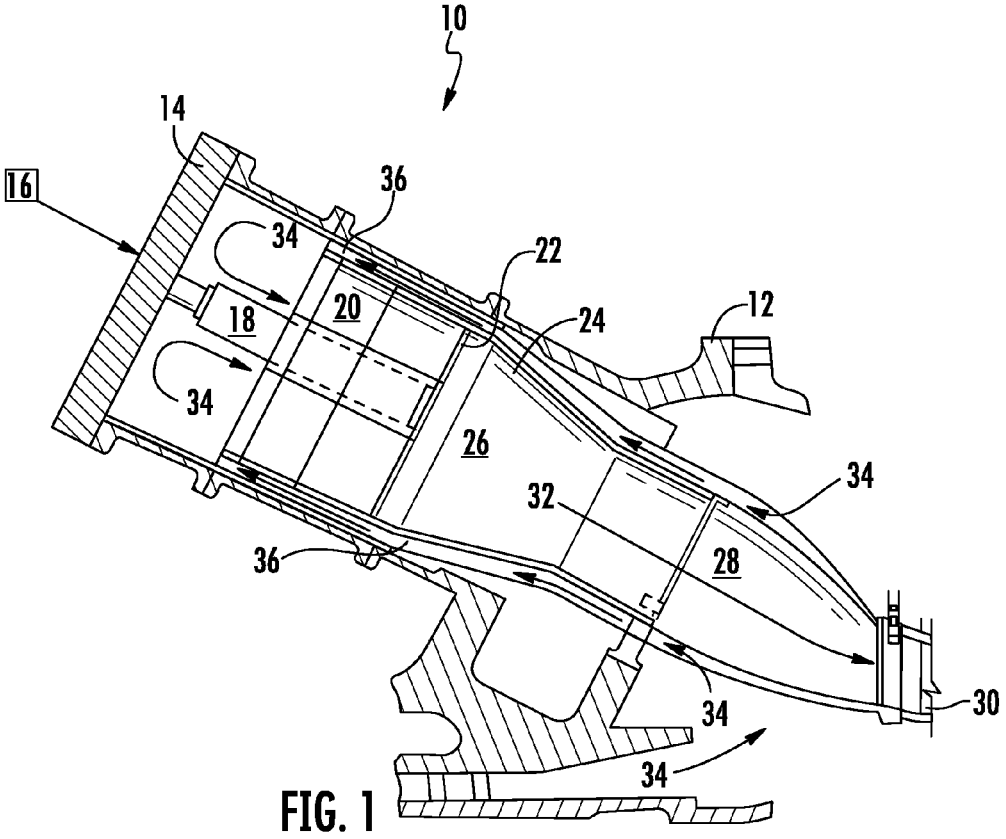
FIG. 1 is a simplified cross-section view of a combustor according to at least one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a cap insert for a cap assembly disposed within a combustor of a gas turbine. In particular embodiments, the cap insert may be coupled to the cap assembly. The cap assembly extends generally axially within the combustor. The cap insert may include a cap plate disposed at a downstream end of the cap insert. The cap plate may have an upstream periphery edge and a fuel nozzle passage that extends generally axially through the cap plate. The cap insert may also include an impingement plate having a body that defines a radially outer portion that circumferentially surrounds the body and includes an upstream end axially separated from a downstream end. The body may further define at least one fuel nozzle passage that extends generally axially through body. In particular embodiments, the fuel nozzle passage may be generally coaxial with the cap plate fuel nozzle passage. In various embodiments, the body may further define a sleeve that extends axially upstream and/or axially downstream from the body. The sleeve may further define the fuel nozzle passage that extends through the impingement plate body.

The impingement plate body may define a plurality of axially extending cooling passages that provide fluid communication through the impingement plate. In particular embodiments, the cap plate upstream peripheral edge may be contiguous with the upstream end of the radially outer portion of the body. In further embodiments, the cap insert may further include a connecting sleeve that extends upstream from the upstream end of the radially outer portion of the impingement plate body. In this manner, the impingement plate radially outer portion may provide axial separation between the connecting sleeve and the cap plate. Generally, the various embodiments of the present invention provide a cap insert that may be less complicated and/or less expensive to manufacture and to replace in existing combustors, thereby resulting in decreased costs to an owner/operator of the gas turbine. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section view of a combustor according to at least one embodiment of the present invention. As shown, the combustor 10 may generally include a casing 12 that at least partially surrounds the combustor 10. An end cover 14 may be disposed at one end of the casing 12. The end cover 14 may be in fluid communication with a fuel supply 16. One or more fuel nozzles 18 may extend generally axially downstream from the end cover 14 within the casing 12. A generally annular cap assembly 20 may at least partially surround the one or more fuel nozzles 18. The one or more fuel nozzles 18 may terminate generally proximate to a downstream end 22 of the cap assembly 20. In certain gas turbine designs, a combustion liner 24 may at least partially surround the downstream end 22 of the cap assembly 20. The combustion liner 24 may extend generally downstream from the cap assembly 20.

A combustion zone 26 may be at least partially defined within at least a portion of the combustion liner 24 generally downstream from the downstream end 22 of the cap assembly 20. A transition duct 28 may extend generally downstream from the combustion liner 24. The transition duct 28 may generally terminate at a point adjacent to a first stage of stationary nozzles 30 of a turbine (not shown). In alternate configurations, the transition duct 28 may surround the downstream end 22 of the cap assembly 20 and extend downstream from the cap assembly 20 and terminate at a point adjacent to the first stage of stationary nozzles 30 of the turbine (not shown), thereby eliminating the necessity for the combustion liner 24. The combustion liner 24 and/or the transition duct 28 may at least partially define a hot gas path 32 for directing hot combustion gases through the combustor 10 and into the turbine (not shown).

In operation, a compressed working fluid 34 may flow into the combustor 10 casing 12 from a compressor (not shown) upstream from the combustor 10. At least a portion of the compressed working fluid 34 may flow towards the end cover 14 through at least one generally annular passage 36 at least partially defined between the casing 12 and at least one of the transition duct 28 or the combustion liner 24. The compressed working fluid 34 may substantially reverse direction at the end cover 14. At least a portion of the compressed working fluid 34 may flow through at least one of the one or more fuel nozzles 18 to premix with a fuel flowing from the fuel supply 16. In addition, at least a portion of the compressed working fluid 34 may flow through the cap assembly 20 to provide cooling the fuel nozzles 18 and/or to provide cooling to the cap assembly 20 downstream end 22. The fuel and the portion of the compressed working fluid 34 flowing through the one or more fuel nozzles 18 may combine to produce a combustible mixture in the combustion zone 26. The combustible mixture is burned to produce the hot combustion gases which flow through the hot gas path 32 and into the turbine (not shown).

Figure 2:
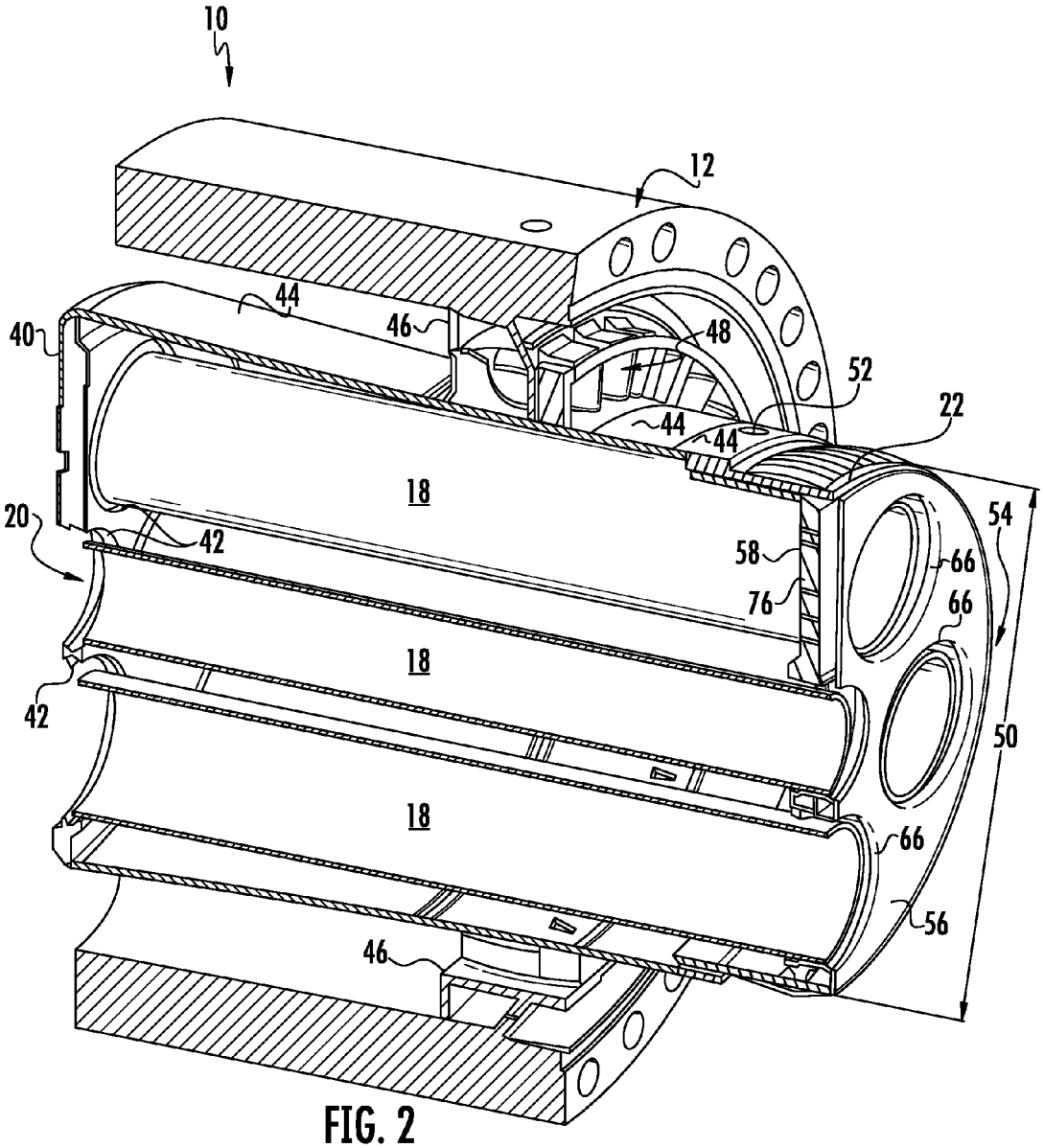
FIG. 2 is an enlarged cross-section perspective view of a portion of the combustor as shown in FIG. 1, according to at least one embodiment of the present invention.

FIG. 2 illustrates an enlarged cross-section perspective view of a portion of the combustor as shown in FIG. 1. As shown in FIG. 2, the cap assembly 20 may include a guide plate 40 that extends generally radially within at least a portion of the combustor casing 12 downstream from the end cover 14. One or more fuel nozzle passages 42 may extend generally axially through the guide plate 40. One or more generally annular shrouds 44 may extend downstream from the guide plate 40. One or more of the one or more annular shrouds 44 may connect to a radial support ring 46 that extends generally radially within the combustor casing 12 downstream from the guide plate 40.

The radial support ring 46 may include one or more struts 48 that extend generally radially outward from the radial support ring 46. At least a portion of the one or more struts 48 may be generally solid. In addition or in the alternative, at least a portion of the one or more struts 48 may define a substantially radially extending cooling passage that provides fluid communication through the one or more struts. At least a portion of the one or more struts 48 may extend generally radially between the radial support ring 46 and the combustor casing 12. At least a portion of the one or more struts 48 may provide fluid communication between a pressurized source of compressed working fluid 34 (not shown) and the cap assembly 20. In particular embodiments, a generally annular opening 50 at the cap assembly downstream end 22 may be at least partially defined by at least one of the one or more annular shrouds 44. In particular embodiments, at least one of the one or more annular shrouds 44 may at least partially define one or more radially extending pin slots 52 upstream from the downstream end 22 of the cap assembly 20.

Figure 3:
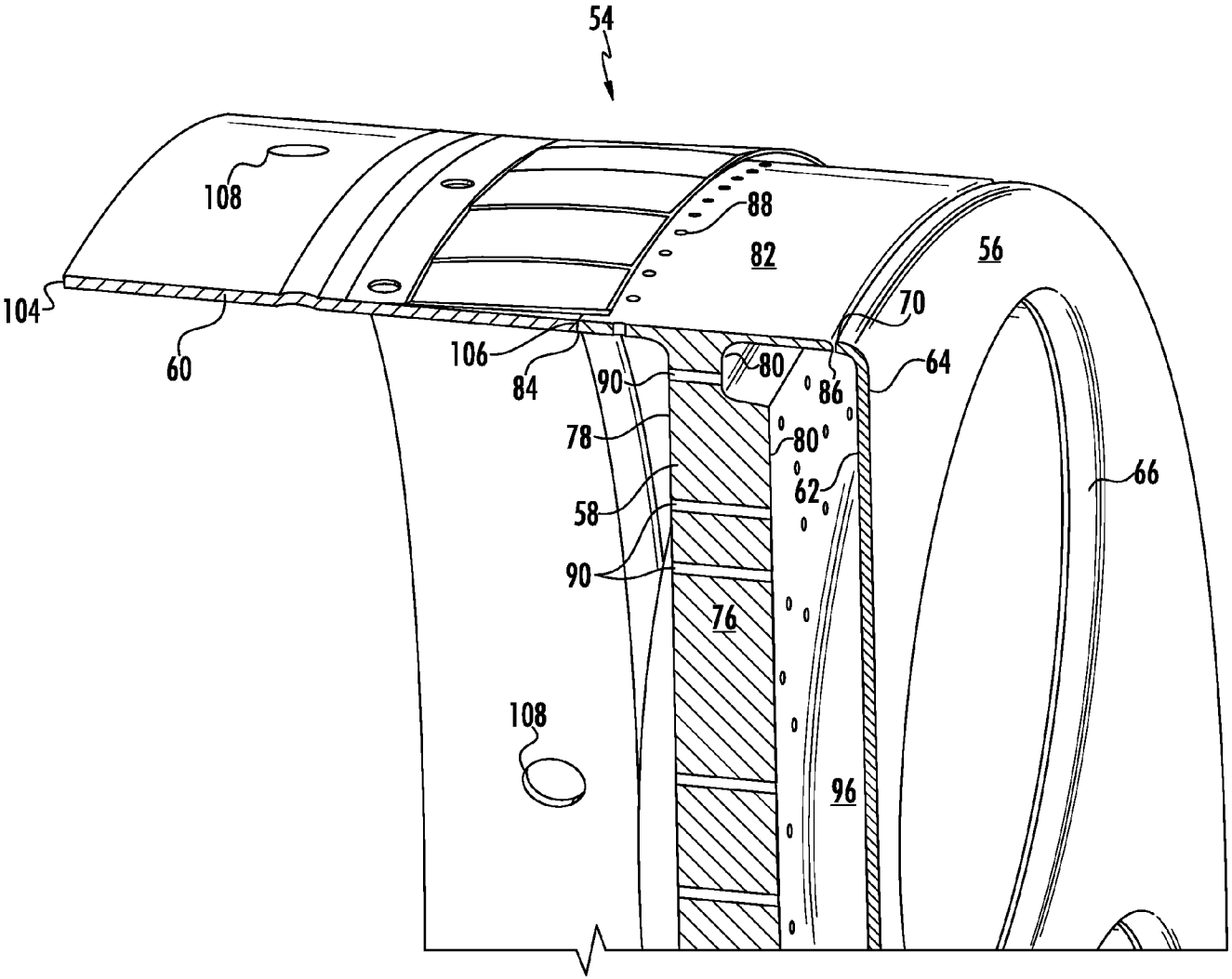
FIG. 3 is an enlarged cross-section side view of a portion of the cap assembly as shown in FIG. 2, according to at least one embodiment of the present invention.
Figure 4:
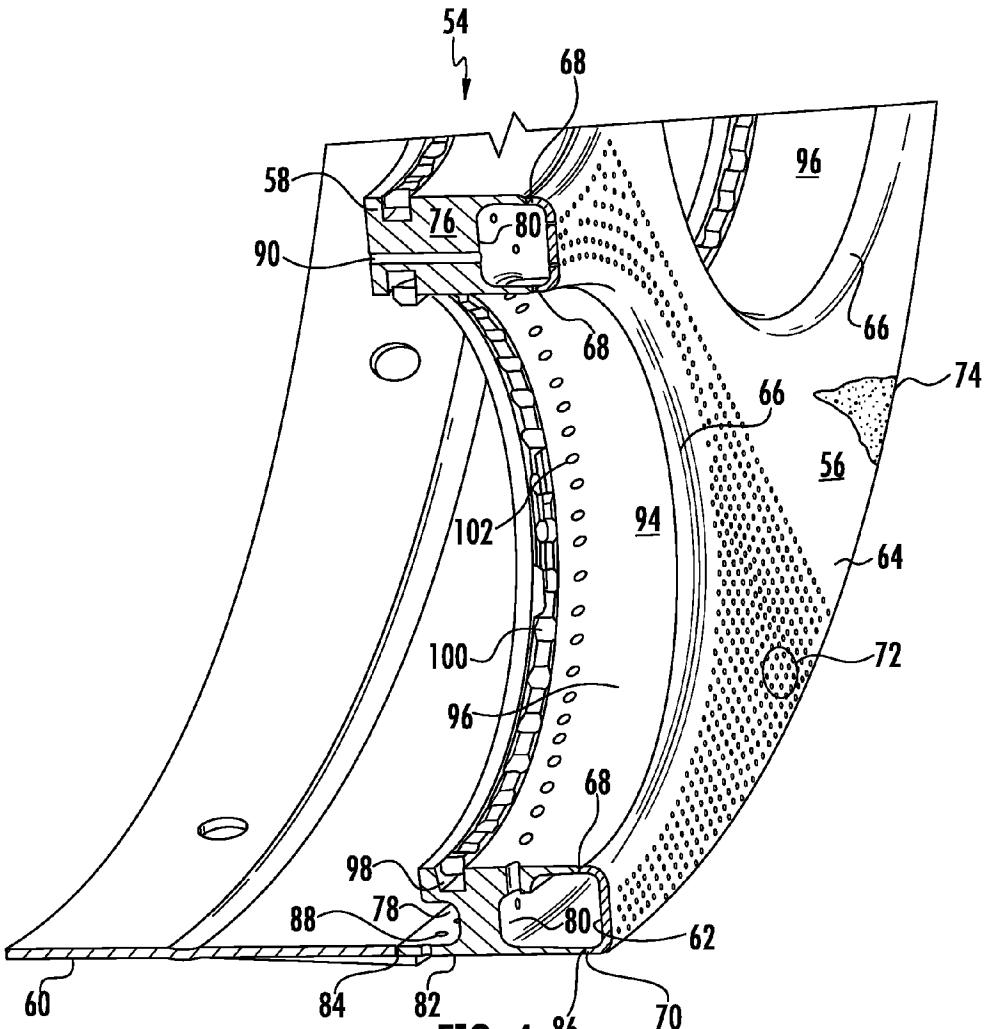
FIG. 4 is an enlarged cross-section prospective view of a cap insert as shown in FIG. 3, according to at least one embodiment of the present invention.

FIG. 3 illustrates an enlarged cross-section prospective view of the cap insert as shown in FIG. 2, and FIG. 4 illustrates an enlarged cross-section prospective view of the cap insert as shown in FIG. 3. As shown in FIG. 2, the cap assembly 20 may generally include a cap insert 54 disposed within the annular opening 50 of the cap assembly 20. As shown in FIGS. 2-4, the cap insert 54 may generally include a cap plate 56 and an impingement plate 58. As shown in FIGS. 3 and 4, the cap insert 54 may also include a connecting sleeve 60. As shown in FIG. 2, the cap plate 56 may be generally circular. However, in alternate configurations, the cap plate 56 may be any shape. For example, but not limiting of, the cap plate 56 may be wedge shaped. As shown in FIGS. 3 and 4, the cap plate 56 generally includes an upstream side 62 herein referred to as "the cold side 62" axially separated from a downstream side 64 herein referred to as the "the hot side 64." In particular embodiments, as shown in FIGS. 2-4, the cap plate 64 may at least partially define at least one fuel nozzle passage 66 that extends generally axially through the cap plate 64. The cap plate 58 fuel nozzle passage 66 may be generally circular so as to allow one of the one or more fuel nozzles 18 shown in FIG. 2, to pass at least partially therethrough. As shown in FIG. 4, at least one of the cap plate 58 one or more fuel nozzle passages 66 may define an upstream surface 68 that circumferentially surrounds the at least one of the cap plate 56 one or more fuel nozzle passages 66.

In particular embodiments, as shown in FIGS. 3 and 4, the cap plate 56 may define an upstream peripheral edge 70 that circumferentially surrounds the cold side 62 of the cap plate 56. In various embodiments, the upstream periphery edge 70 may extend generally axially upstream from the cap plate cold side 62. In particular embodiments, as shown in FIG. 4, the cap plate 64 may define a plurality of cooling passages 72 that extend substantially axially through the cap plate 56 so as to provide fluid communication through the cap plate 56 from the cold side 62 to the hot side 64. In addition or in the alternative, the hot side 64 of the cap plate 56 may be coated with a heat resistant material 74 such as a thermal barrier coating in order to reduce thermal stresses on the cap plate.

The impingement plate 58, as shown in FIG. 2, may be generally circular. However, in alternate configurations, the impingement plate 58 may be any shape so as to complement the shape of the cap plate 56. As shown in FIGS. 3 and 4, the impingement plate 58 generally includes a body 76. The body generally includes an upstream side 78 and a downstream side 80. The downstream side may be generally axially separated from the upstream side 78. The body 76 may be cast and/or machined from a single piece of material. In particular embodiments, the body 76 may define a radially outer portion 82 that extends circumferentially around the impingement plate 58. The radially outer portion 82 generally includes an upstream end 84 axially separated from a downstream end 86. In various embodiments, the radially outer portion 82 may extend axially upstream from the body 84 and/or axially downstream from the body 84.

In various embodiments, as shown in FIG. 3, a plurality of radially extending cooling passages 88 may extend through the radially outer portion 82 of the impingement plate body 76. In particular embodiments, at least a portion of the plurality of radially extending cooling passages 88 may extend through the radially outer portion 82 upstream from the impingement plate body 76 upstream side 78. In addition or in the alternative, at least a portion of the plurality of radially extending cooling passages 88 may extend through the radially outer portion 82 downstream from the impingement plate body 76 downstream side 80.

In particular embodiments, as shown in FIGS. 3 and 4, the upstream periphery edge 70 of the cap plate 56 may be contiguous with the outer portion downstream end 86 of the impingement plate body 76. In this manner, the cap plate 56 may be easily installed on and/or separated from the impingement plate 58 for repair or replacement, thereby decreasing the time and/or the cost to repair the cap assembly 20. The cap plate 56 upstream periphery edge 70 may be attached to the downstream end 86 of the impingement plate 58 radially outer portion 82 by any means known in the art sufficient to withstand the operating environment within the combustor 10. For example, but not limiting of, the cap plate 56 upstream periphery edge 70 may be attached to the radially outer potion downstream end 86 by welding and/or brazing.

In particular embodiments, as shown in FIGS. 3 and 4, the impingement plate body 76 may define a plurality of axially extending cooling passages 90. As shown in FIG. 4, at least a portion of the axially extending cooling passages 90 may provide fluid communication through the impingement plate 58 and into a plenum 92 that may be at least partially defined between the impingement plate 58 and the cap plate 56. The plurality of axially extending cooling passages 90 may be sized, shaped and/or arranged so as to optimize flow of a cooling medium such as the compressed working fluid through the impingement plate 58. For example, but not limiting of, at least a portion of the plurality of axially extending cooling passages 90 may be sized according to the following formula:

$$L/D \qquad 2$$

where the variable "L" is equal to the axial length of the axially extending cooling passages 90, and the variable "D" is equal to a diameter of the axially extending cooling passages 90. In this manner, the value of variable "L" may be related to the thickness of the impingement plate body 76. As a result, designers may use the formula as a guide to determine an optimal thickness for the impingement plate 58.

In particular embodiments, as shown in FIGS. 3 and 4, the impingement plate body 76 may further define one or more axially extending annular sleeves 94. The one or more annular sleeves 94 may define one or more annular passages through the impingement plate body 76. The one or more annular sleeves may extend axially outward from the impingement plate body 76 upstream and/or downstream sides, 78 and 80 respectfully. In the alternative, the one or more annular sleeves 94 may be separate components that extend through and may be coupled to the impingement plate body 76.

As shown in FIGS. 3 and 4, the one or more annular sleeves 94 may extend between the impingement plate body 76 and the cap plate 56. In particular embodiments, each of the cap plate 56 one or more fuel nozzle passages 66 may be generally coaxial to each of the one or more annular sleeves 94. In this manner, the one or more fuel nozzles 18 may extend through the impingement plate body 76 and terminate generally adjacent to the cap plate 56, as shown in FIG. 1. As shown in FIG. 4, the upstream end 68 of the one or more fuel nozzle passages 66 of the cap plate 56 may be coupled to one end of the one or more annular sleeves 94. For example, but not limiting of, the upstream end 68 of the one or more fuel nozzle passages 66 of the cap plate 56 may be coupled to the one or more annular sleeves 96 by at least one of welding or brazing.

As shown in FIG. 4, the one or more annular sleeves 94 generally define an inner surface 96. In particular embodiments, at least some of the one or more annular sleeves 94 may include a seal slot 98 that extends radially into and at least partially circumferentially around the at least some of the one or more annular sleeves 94 inner surfaces 96. In further embodiments, a seal 100 such as a piston ring seal may be disposed in each seal slot 98. In further embodiments, the one or more annular sleeves 94 may define a plurality of radially extending cooling passages 102. As shown, the radially extending cooling passages 102 may be disposed generally downstream from each seal slot 98.

As shown in FIG. 3, the cap insert 54 connecting sleeve 60 may have an upstream end 104 axially separated from a downstream end 106. In particular embodiments, the connecting sleeve 60 downstream end 106 may be contiguous with the radially outer portion upstream end 84 of the impingement plate body 76. The connecting sleeve 60 downstream end 106 may be joined to the radially outer portion upstream end 84 of the impingement plate body 76 by welding, brazing or by any process known in the art capable of withstanding the environment within the combustor 10 during operation. In particular embodiments, as shown in FIG. 3, a plurality of radially extending pin slots 108 may extend generally radially through the connecting sleeve 60. The plurality of radially extending pin slots 108 may be arranged so as to align with the one or more radially extending pin slots 52 of the cap assembly 20, as shown in FIG. 2. In this manner, one or more connecting pins (not shown) may be inserted through the aligned pin slots 52 and 110, during installation of the cap insert 54 in order to secure the cap insert 54 to the cap assembly 20. As a result, the cap insert 54 may be removed for repair and/or replacement without having to disassemble the entire cap assembly 20, thereby reducing outage time and maintenance expense.

During operation of the combustor 10, at least a portion of the compressed working fluid 34 may flow through the cap assembly 20 towards the cap insert 54 impingement plate 58. A portion of the compressed working fluid 34 may be directed through the plurality of axially extending cooling passages 90 of the impingement plate body 76 and into the plenum 92 defined between the cap plate 56 and the impingement plate 58. The length, the diameter and/or the angle at which the axially extending cooling passages 90 extend through the impingement plate body 76 may control the flow rate and/or flow direction of the compressed working fluid 34 that flows therethrough. The compressed working fluid 34 may then flow into and/or across the cold side 62 of the cap plate 56, thereby providing at least one of conductive or convective cooling to the cap plate 56 cold side 62. In addition, the compressed working fluid 34 may flow through the plurality of cooling passages 72 that extend through the cap plate 56 and into the combustion zone 26, thereby cooling providing film cooling to the hot side 64 of the cap plate 56.

The cap insert 54, as disclosed herein, provides several benefits over existing technology. For example, the cap insert 54 shown and described with respect to FIGS. 2-4 obviates the need for existing complicated cap assembly structures by reducing the quantity of components, thereby simplifying the manufacturing and the assembly processes and/or steps required to produce existing cap assemblies. In addition, the plurality of axially extending cooling passages 90 that extend through the impingement body 76 allow for enhanced control of the flow of the compressed working fluid 34 through the impingement plate 58, thereby improving cooling of the cap plate 56 and enhancing overall performance of the combustor 10. In addition, the one or more annular sleeves 94 of the impingement plate body 76 provide a rigid support for each one the one or more fuel nozzles 18 extending therethrough, while decreasing the mechanical complexity and/or the structural stresses on the cap plate 56. In addition or in the alternative, the connecting sleeve 60 of the cap insert 54 and the plurality of coupling pins (not shown) allow for simplified installation and removal of the cap insert 54 into the cap assembly 20. As a result, the time required to assemble and/or disassemble the cap assembly 20 may be greatly reduced, thereby providing substantial savings in labor costs and costs associated with gas turbine outages. These and other advantages may be realized upon practice of the various embodiments described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cap insert for a combustor comprising:

a. a cap plate defining a fuel nozzle passage and comprising an upstream peripheral edge;

b. an impingement plate having a body, the body defining an axially extending annular sleeve and a radially outer portion that circumferentially surrounds the body, the radially outer portion having an upstream end axially separated from a downstream end, and the axially extending annular sleeve defining an annular passage through the body; and c. wherein the cap plate upstream peripheral edge is contiguous with the downstream end of the impingement plate body radially outer portion and wherein the impingement plate axially extending annular sleeve comprises an inner surface and a seal slot that extends circumferentially around the inner surface.

2. The cap insert as in claim 1, further comprising a plurality of axially extending cooling passages that extend through the impingement plate body.

3. The cap insert as in claim 1, further comprising a plurality of generally radially extending cooling passages that extend through the impingement plate axially extending annular sleeve.

4. The cap insert as in claim 1, wherein the impingement plate axially extending annular sleeve extends between the impingement plate body and the cap plate.

5. The cap insert as in claim 1, wherein the impingement plate axially extending annular sleeve is connected to the cap plate.

6. The cap insert as in claim 1, wherein the impingement plate axially extending annular sleeve extends upstream from the impingement plate body.

7. The cap insert as in claim 1, further comprising a plurality of radially extending cooling passages that extend through the impingement plate body radially outer portion.

8. The cap insert as in claim 1, wherein the cap plate further comprises a plurality of cooling passages that extend generally axially through the cap plate.

9. A cap insert for a combustor comprising:

a. an impingement plate having a body, the body defining an axially extending annular sleeve that defines a passage through the body;

b. a cap plate that defines a fuel nozzle passage generally coaxial with the axially extending annular sleeve, the cap plate comprising an upstream peripheral edge, the upstream peripheral edge contiguous with a downstream end of the impingement plate; and c. a connecting sleeve contiguous with an upstream end of the impingement plate such that the cap plate and the connecting sleeve are axially separated by the impingement plate;

d. wherein the impingement plate axially extending annular sleeve comprises an inner surface and a seal slot that extends circumferentially around the inner surface.

10. The cap insert as in claim 9, further comprising a plurality of radially extending pin slots that extend through the connecting sleeve.

11. The cap insert as in claim 9, further comprising a plurality of axially extending cooling passages that extend through the impingement plate body.

12. The cap insert as in claim 9, further comprising a plurality of generally radially extending cooling passages that provide fluid communication through the impingement plate body axially extending annular sleeve.

13. The cap insert as in claim 9, wherein the impingement plate axially extending annular sleeve extends between the impingement plate body and the cap plate.

14. The cap insert as in claim 9, wherein the impingement plate axially extending annular sleeve is coupled to the cap plate.

15. A combustor comprising:

a. an end cover disposed at one end of the combustor, and a fuel nozzle that extends axially downstream from the end cover;

b. a cap assembly that at least partially surrounds the fuel nozzle and that extends axially downstream from the end cover, the cap assembly having an opening at a downstream end of the cap assembly; and c. a cap insert disposed within the cap assembly opening, the cap insert comprising:

i. an impingement plate having a body, the body defining an axially extending annular sleeve that defines a passage through the body, and a plurality of axially extending cooling passages that extend through the body;

ii. a cap plate that defines a fuel nozzle passage generally coaxial with the impingement plate body axially extending annular sleeve, the cap plate comprising an upstream peripheral edge, the upstream peripheral edge contiguous with a downstream end of the impingement plate; and iii. a connecting sleeve contiguous with an upstream end of the impingement plate, wherein the cap plate and the connecting sleeve are axially separated by the impingement plate;

iv. wherein the impingement plate axially extending annular sleeve includes an inner surface and a seal slot that extends radially into and circumferentially around the inner surface.

16. The combustor as in claim 15, wherein the fuel nozzle passes through the impingement plate axially extending annular sleeve, the combustor further comprising a seal disposed within the seal slot.

17. The combustor as in claim 15, wherein the impingement plate body further defines a radially outer portion having an upstream end axially separated from a downstream end, the connecting sleeve contiguous with the upstream end and the cap plate contiguous with the downstream end.

* * * * *